US007575293B2

(12) United States Patent
Snyder et al.

(10) Patent No.: US 7,575,293 B2
(45) Date of Patent: Aug. 18, 2009

(54) DUAL DROP PRINTING MODE USING FULL LENGTH WAVEFORMS TO ACHIEVE HEAD DROP MASS DIFFERENCES

(75) Inventors: Trevor J. Snyder, Newberg, OR (US); David L. Knierim, Wilsonville, OR (US); Joel Chan, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 771 days.

(21) Appl. No.: 11/139,549

(22) Filed: May 31, 2005

(65) Prior Publication Data

US 2006/0268031 A1 Nov. 30, 2006

(51) Int. Cl.
*B41J 29/38* (2006.01)

(52) U.S. Cl. ..... 347/9; 347/12

(58) Field of Classification Search ..... 347/9–12, 347/15, 41

See application file for complete search history.

(56) References Cited

U.S. PATENT DOCUMENTS 5,412,410 A 5/1995 Rezanka
5,495,270 A 2/1996 Burr et al.
5,734,393 A 3/1998 Eriksen
5,745,131 A 4/1998 Kneezel et al.
5,949,452 A 9/1999 Jones
6,079,811 A 6/2000 Cornell et al.
6,244,686 B1 6/2001 Jensen et al.
6,338,542 B1 * 1/2002 Fujimori ..... 347/40
6,402,280 B2 6/2002 Kneezel et al.
6,464,330 B1 10/2002 Miller et al.
2003/0007024 A1 * 1/2003 Fujimori ..... 347/15
2005/0057594 A1 * 3/2005 Kakutani ..... 347/15

* cited by examiner

*Primary Examiner*—Julian D Huffman
(74) *Attorney, Agent, or Firm*—Oliff & Berridge, PLC

(57) ABSTRACT

A dual-drop mode for a printer uses at least two full length waveforms and switches between the waveforms according to one or more patterning methodologies to print a page length document having a dual drop size print pattern across the printed portion of the page. This achieves printing from individual jet nozzles of either a large drop or a small drop. The page size patterning methodology is performed globally on at least a sub-page basis, rather than on a pixel-by-pixel basis and may be performed based on or independent of specific image data. In exemplary embodiments, printing is achieved using multiple print passes, with at least two print passes using different sized ink droplets.

20 Claims, 9 Drawing Sheets

DUAL DROP PRINTING MODE USING FULL LENGTH WAVEFORMS TO ACHIEVE HEAD DROP MASS DIFFERENCES

BACKGROUND

Dual-drop printing is achieved using two or more full length waveforms and a predetermined jet geometry that generates two or more different drop masses from each jet for a given page.

Dual-drop mode refers to the ability of the printhead to generate two or more different drop masses. However, only one of these masses is typically used in a given image. This is accomplished with the use of separate full length waveforms that achieve different drop masses for any given jet nozzle. For example, the Phaser 340, available from Xerox Corporation, used this to achieve a 110 ng drop and a 67 ng drop by firing one of the two waveforms depending on a mode of operation. In order to achieve the smaller drop with the same jet geometry, the smaller drop waveform was run at a lower frequency.

Drop-size-switching (DSS) refers to the ability of a jet to generate a multitude of drop masses (two, for example) on-the-fly. This can be accomplished by fitting two half (½) length waveforms into the jetting time 1/fop. Here "fop" refers to "frequency of operation", which is the frequency at which drops eject from each jet of a print head when firing continuously. The electronics select one of the two waveforms according to one or more patterning methodologies to print a page length document. This achieves printing from individual jet nozzles of either a large drop or a small drop.

As shown in FIG. 1, a printhead driver 200 incorporates two separate waveforms (waveform 1 and waveform 2) into a single print firing period (1/fop). One of the two waveforms is selected "on the fly" by driver 200 to drive individual jets of printhead 100 based on specific image criteria or image quality. Printhead 100 includes an aperture plate 110 and a diaphragm plate 120. A piezoelectric transducer 130 is provided on the diaphragm plate 120. Between the two plates 110, 120 are defined ports 140, feed lines 150, manifold 160, inlet 170, body 180, outlet 185, and apertures 190. An example of this type of "on the fly" printhead is further described in U.S. Pat. No. 5,495,270 to Burr et al., the disclosure of which is hereby incorporated herein in its entirety.

This concept was introduced in the Phaser 850 Enhanced Mode, also available from Xerox Corporation. Both a 51 ng and a 24 ng drop size could be generated "on the fly." However, in this design, the printhead ran at the slower frequency of the small drop. Because the smaller drop ran at a lower frequency, it could not be printed at high speed. However, because the large drop was available to allow an overall reduction in resolution while maintaining appropriate total solid coverage, the dual-drop mode worked and was beneficial.

SUMMARY

There is always a quality/speed tradeoff that must be made when setting the dropmass of a printer. Large drops are needed in solid fill regions to increase color saturation at lower resolutions that afford higher print speeds, and small drops are needed in light fill regions to reduce graininess. Printing with multiple drop sizes on each image improves the image quality for a given speed and/or increases the speed for a given image quality because large drops fill solid color regions quickly while small drops reduce graininess in lighter shaded regions.

The primary limitation of the Phaser 850 method of dual-drop printing is the need to fit both a small drop waveform and a large drop waveform in a single firing period (1/fop). As newer jet designs operate at higher frequencies (increased fop), the associated period (1/fop) becomes too short to fit two waveforms. Accordingly, there is a need for an improved printing architecture and method that can address this limitation.

In accordance with various aspects, a printer architecture uses a modified DSS mode "Soft DSS" that allows smaller drops in light fill areas to decrease graininess in the image, while also allowing larger drops in solid fill areas to increase color saturation at lower resolutions to improve print quality at either extreme.

In accordance with various other aspects, a printer architecture uses a Soft DSS mode having full length waveforms, which are easier to develop and implement than half length waveforms. That is, they are much simpler design and implement robustly within required product time cycles. An additional benefit of this "Soft DSS" mode it to maximize print speed because there will not be the wait time between pulses inherent in an "on the fly" dual-drop mode system using partial length waveforms that require slower print frequencies.

In accordance with exemplary embodiments, a Soft DSS mode printer architecture provides a page output with an alternating pattern of small and large drop sizes. In one exemplary arrangement, the pattern is achieved in two or more passes by providing a first pass using a first drop size and first predetermined resolution, followed by printing at least one subsequent pass with a second different drop size and a second predetermined resolution. The second resolution may be the same or different from the first resolution. In various exemplary embodiments, the pattern layout is for an entire page, but can be performed on a sub-page basis.

BRIEF DESCRIPTION OF THE DRAWINGS

Exemplary embodiments will be described with reference to the drawings, wherein.

DETAILED DESCRIPTION OF EMBODIMENTS

In accordance with exemplary embodiments, a modified dual-drop mode printer architecture provides a page output with an alternating pattern of small and large drop sizes. Alternative designs and operation are disclosed in co-pending U.S. application Ser. No. 11/139,700 filed May 31, 2005, the disclosure of which is hereby incorporated herein by reference in its entirety. This is particularly beneficial when used with a phase-change, offset solid ink printer.

Figure 1:
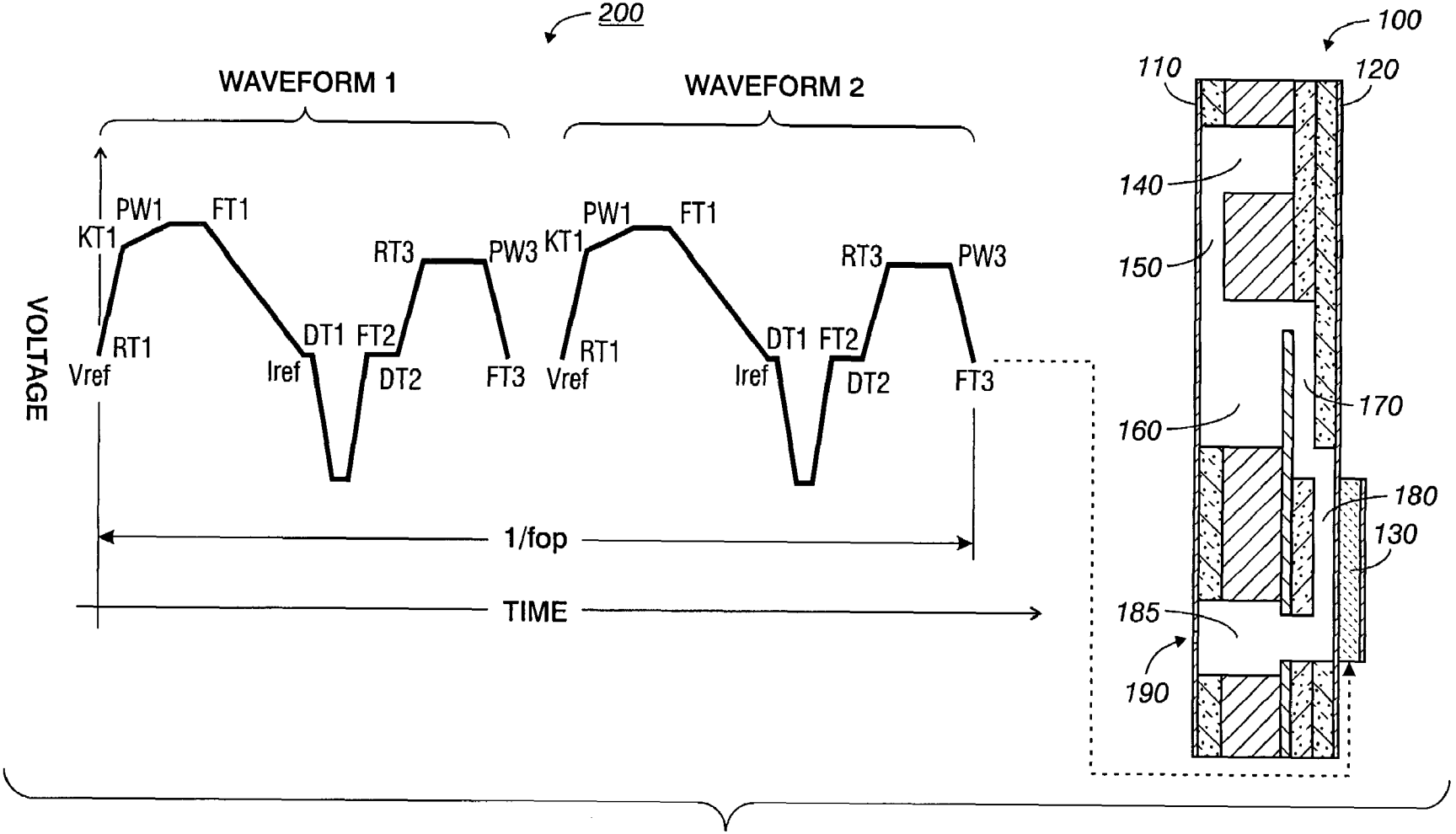
FIG. 1 RELATED ART
FIG. 1 illustrates across-sectional view of a conventional single geometry ink nozzle driven by one of two known dual-drop half-frequency waveforms to achieve either a large or small drop mass size.
Figure 2:
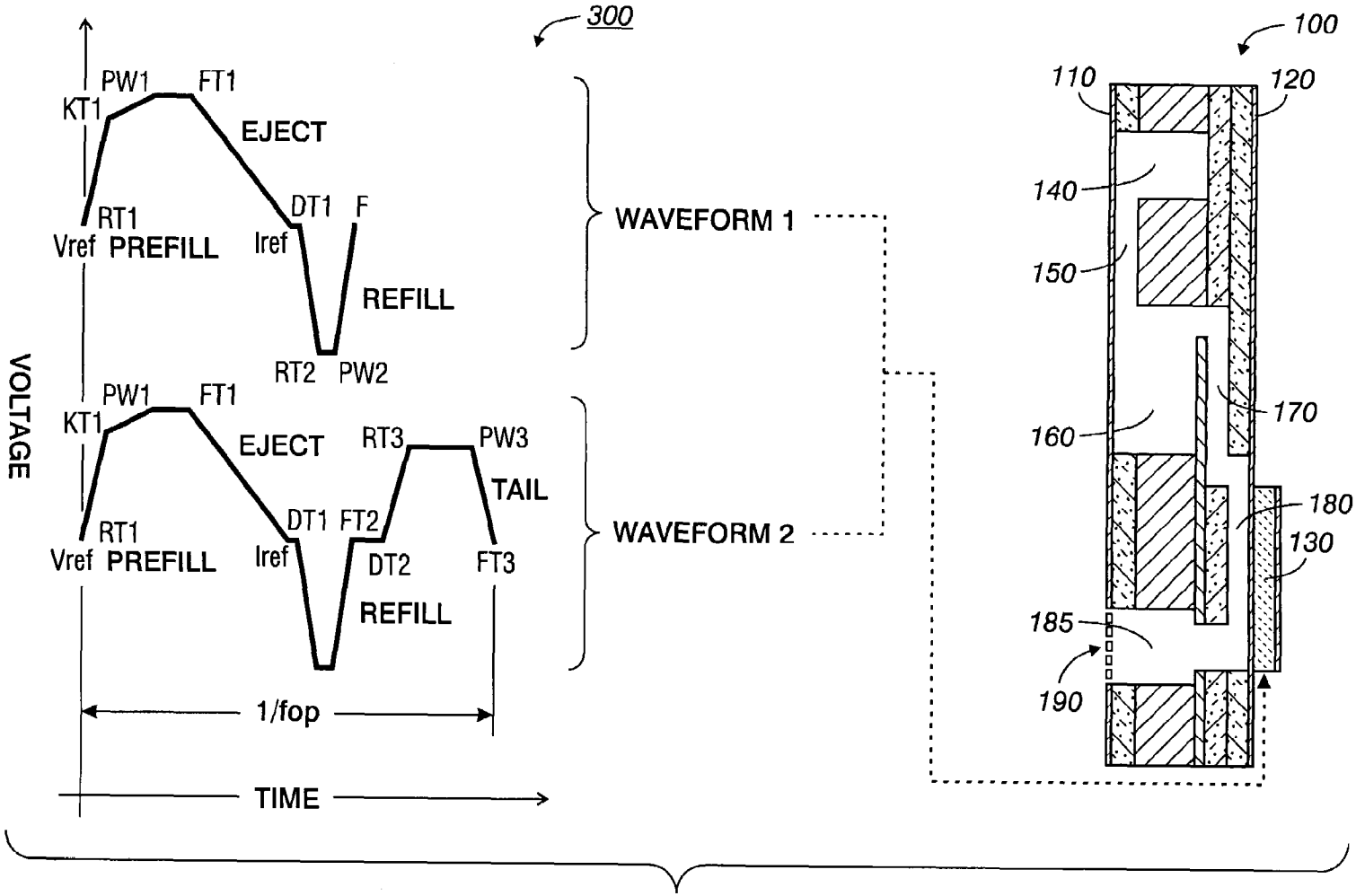
FIG. 2 illustrates a cross-sectional view of an exemplary single geometry ink nozzle driven by one of two dual-drop full frequency waveforms to achieve either a large or small drop mass size.

In the exemplary embodiment of FIG. 2, printhead 100 of a printer 400 (shown in FIG. 3) includes an aperture plate 110 and a diaphragm plate 120. A piezoelectric transducer 130 is provided on the diaphragm plate 120. An array of apertures 190 forming individual fluid nozzles is defined on the aperture plate 110. The array is closely and uniformly spaced with a predetermined spi (spot per inch) resolution. The apertures 190 are connected to a fluid source through various channels.

A suitable fluid, such as a phase-change solid ink that has been heated to liquid form, flows to an ink manifold 160 from an inlet port 140 through feed line 150. Ink from manifold 160 flows through an inlet 170 to a pressure chamber 180 where it is acted on by transducer 130, such as a piezoelectric transducer. Piezoelectric transducer 130 is driven by a printhead driver 300, which applies a particular waveform that deforms transducer 130 to displace an amount of ink within the pressure chamber 180 through outlet 185. Ultimately this amount of ink is forced through apertures 190 to eject a predetermined mass of ink from the printhead 100. Reverse bending of transducer 130 following ejection causes a refill of ink into the pressure chamber 180 to load the chamber for a subsequent ejection cycle.

In exemplary embodiments, the geometry of each aperture and outlet is common to all fluid nozzles. However, by application of one of two different full length waveforms, two different drop sizes can be produced from this common printhead nozzle geometry.

Printhead 100 can be manufactured as known in the art using conventional photo-patterning and etching processes in metal sheet stock or other conventional or subsequently developed materials or processes. The specific sizes and shapes of the various components would depend on a particular application and can vary. The transducer can be a conventional piezo transducer. One common theme in embodiments is that the geometry of each nozzle is the same, and achieves droplet size difference through selection of drive waveform.

Figure 3:
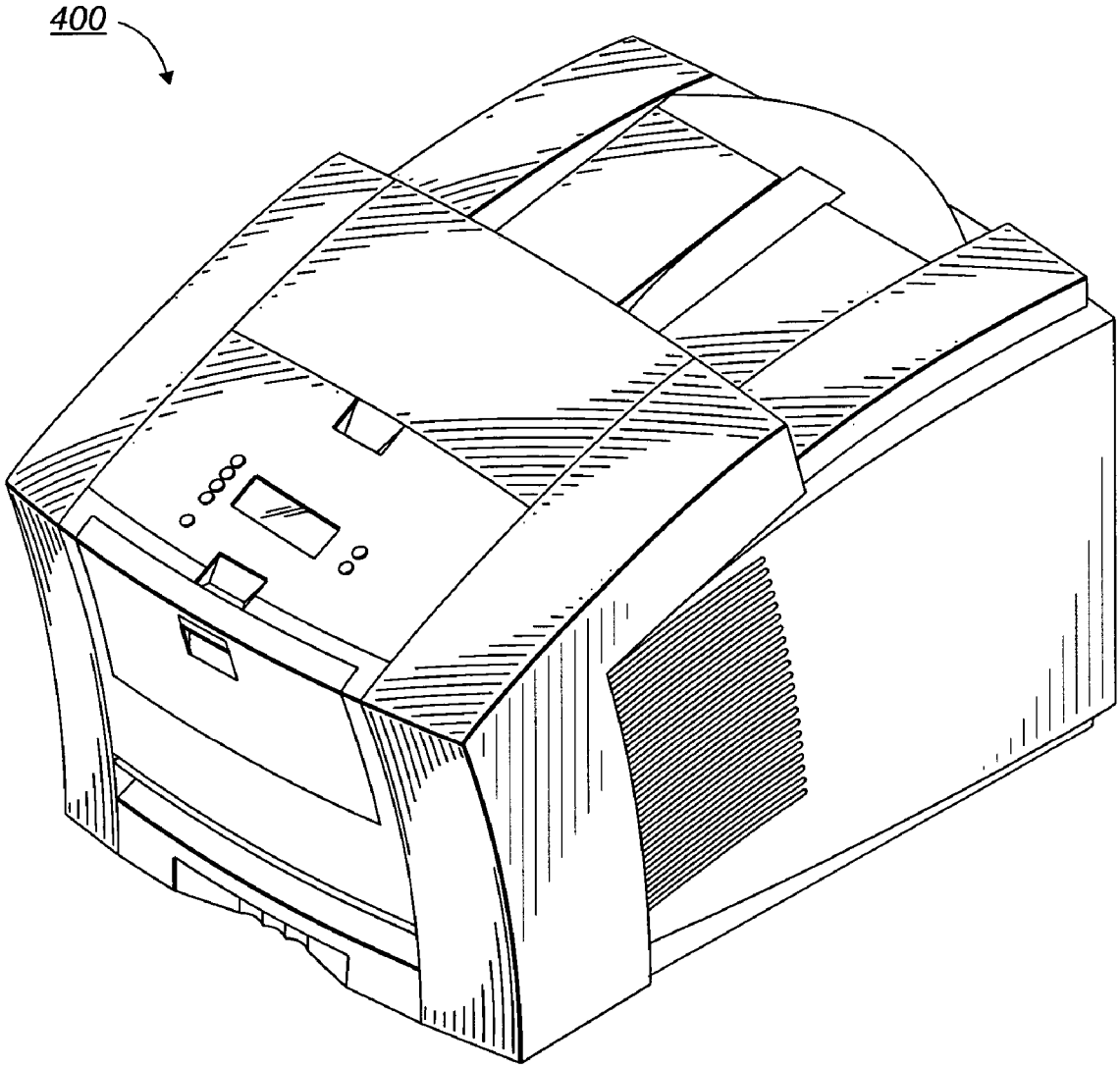
FIG. 3 illustrates a perspective view of an exemplary fluid ejection device.
Figure 4:
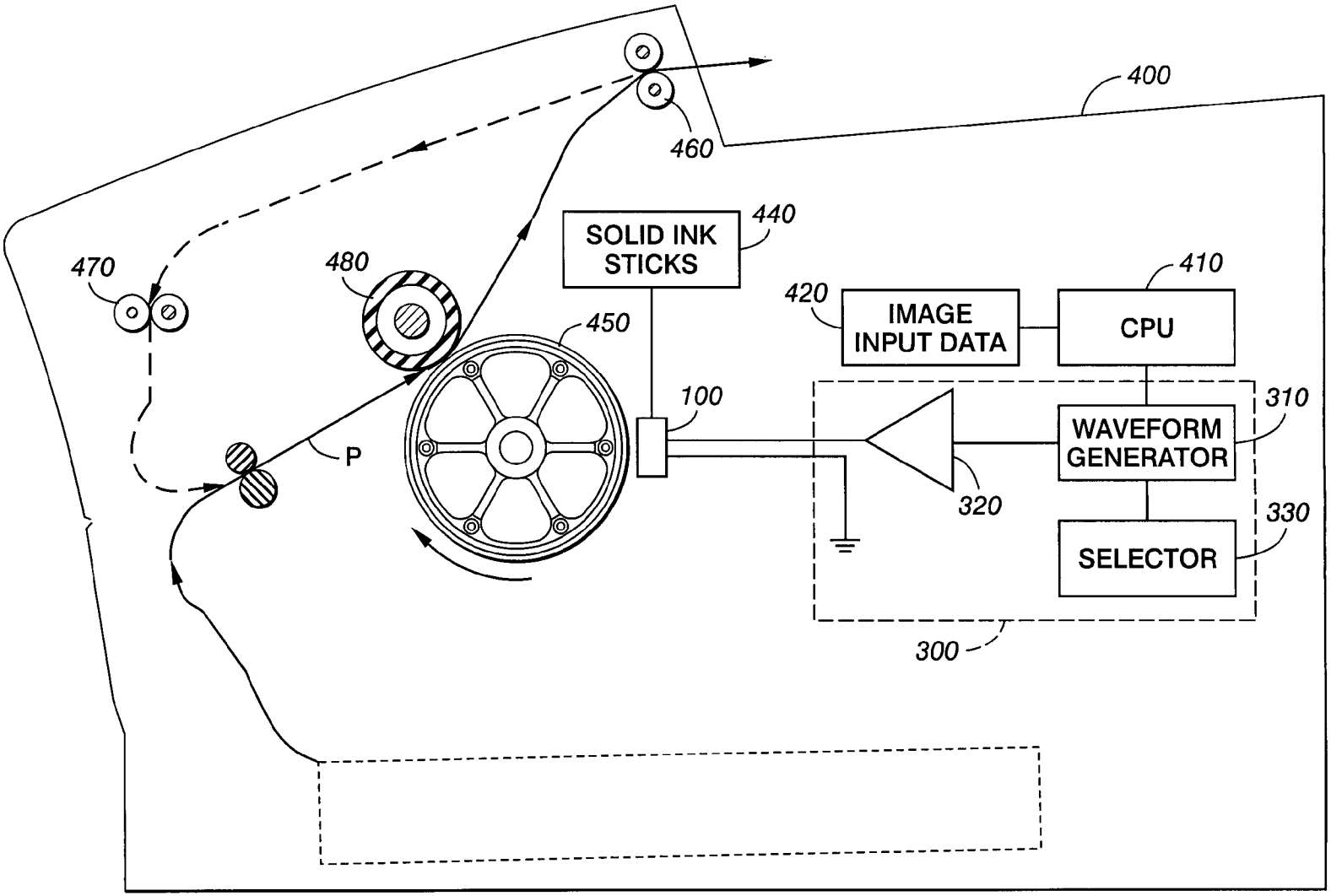
FIG. 4 illustrates a schematic block diagram showing the exemplary fluid ejection device of FIG. 3 having an apparatus used to generate the piezoelectric drive waveforms of FIG. 2.
Figure 5:
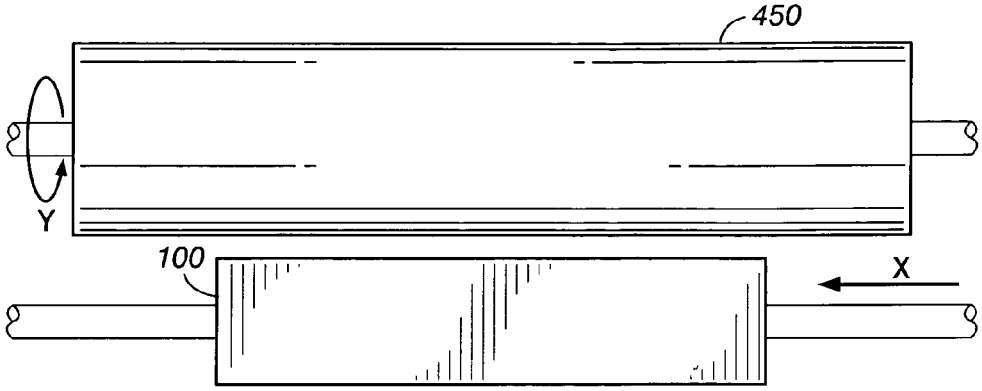
FIG. 5 illustrates a top pictorial view showing a printhead mounted to a shaft for translational X-axis movement while an adjacent drum supporting an intermediate transfer surface is rotated about a Y-axis.

An exemplary printer is a solid-ink offset printer 400 shown in FIGS. 3-5. In an offset printing system, the printhead 100 jets a fluid, such as phase-change solid ink, onto an intermediate transfer surface, such as a thin oil layer on a drum 450. A final receiving medium, such as a sheet of paper P, is then brought into contact with the intermediate surface where the image is transferred. In a typical offset printing architecture, the printhead 100 translates in an X-direction, as better shown in FIG. 5, while the drum rotates perpendicularly along a Y-axis. Typically, the printhead 100 includes multiple jets configured in a linear array to print a set of scan lines on the intermediate transfer surface on drum 450 during each rotation of the drum. Precise movement of the X-axis and Y-axis translation is required to avoid unnecessary artifacts. This can be achieved, for example, using a print head drive mechanism such as the ones described in U.S. Pat. No. 6,244,686 to Jensen et al. and U.S. Pat. No. 5,389,958 to Bui et al., the subject matter of which is hereby incorporated herein by reference in its entirety.

Ejecting ink drops having dual controllable volume/mass is achieved by printhead driver 300, which is better illustrated in FIG. 4. Driver 300 is provided within printer 400 and includes a waveform generator 310 capable of generating multiple waveform patterns. As shown in FIG. 2, exemplary embodiments provide at least two selectable full wavelength patterns (waveform 1 and waveform 2). Transducer 130 responds to the selected waveform by inducing pressure waves in the ink that excite ink fluid flow resonance in outlet 185. A suitable waveform is selected using selector 330, based on criteria to be described later in more detail. The waveform selected is fed to amplifier 320. From amplifier 320, an amplified signal is delivered to the piezoelectric transducer of printhead 100, driving one or more rows of jets in the printhead. Movement of the piezoelectric transducer causes ejection of a suitable volume of fluid, such as ink, from printhead 100 of printer 400 based on image signals received from a source (such as a scanner or stored image file) in image data input 420 and controlled by CPU 410 of the printer.

Ink is provided in a storage area 430 and supplied to printhead 100 through an ink reservoir 440. In an exemplary embodiment, printer 400 is a solid ink printer that contains one or more solid ink sticks in storage area 430. The solid ink sticks are melted and jetted from ink jet nozzles of the printhead 100 onto the intermediate transfer surface on drum 450, which may be rotated one or several revolutions to form a completed intermediate image on the transfer surface on the drum. At that time, a substrate, such as paper, can be advanced along a paper path that includes roller pairs 460, 470 and between a transfer roller 480 and drum 450 where the image is transferred onto the paper in a single pass as known in the art.

A different resonance mode may be excited by each full wavelength waveform to eject a different drop volume/mass in response to each selected mode. In the FIG. 2 example, one waveform (waveform 1) may provide a small drop size, while the other waveform (waveform 2) may provide a large drop size when driving jet nozzles having the same nozzle geometry. The waveform design chosen would be based on the design constraints of the fluid pathway, the transducer operating parameters, the meniscus parameters of the fluid, and the like. Selection of modal properties can be determined by empirical modeling or experimentation based on known governing principles. For example, details of the equations governing fluid dynamics relevant to fluid ejection can be found in U.S. Pat. No. 5,495,270 to Burr et al., the subject matter of which is hereby incorporated herein by reference in its entirety. From these and other conventional teachings, one of ordinary skill can select appropriate full length waveforms to produce a desired droplet size.

An important aspect of the disclosure is in the control of the waveforms on a page or image basis that can use printhead 100 to drive the various nozzles with a particular pattern of large and small ink drops on a page to achieve benefits of each size drop. That is, the drops do not need to be generated "on the fly" on a pixel-by-pixel basis, but the decision can be made on a more global basis by using a pattern of both small and large drop sizes. This is achieved using a printhead having common ink nozzle geometries across the array of nozzles.

Figure 6:
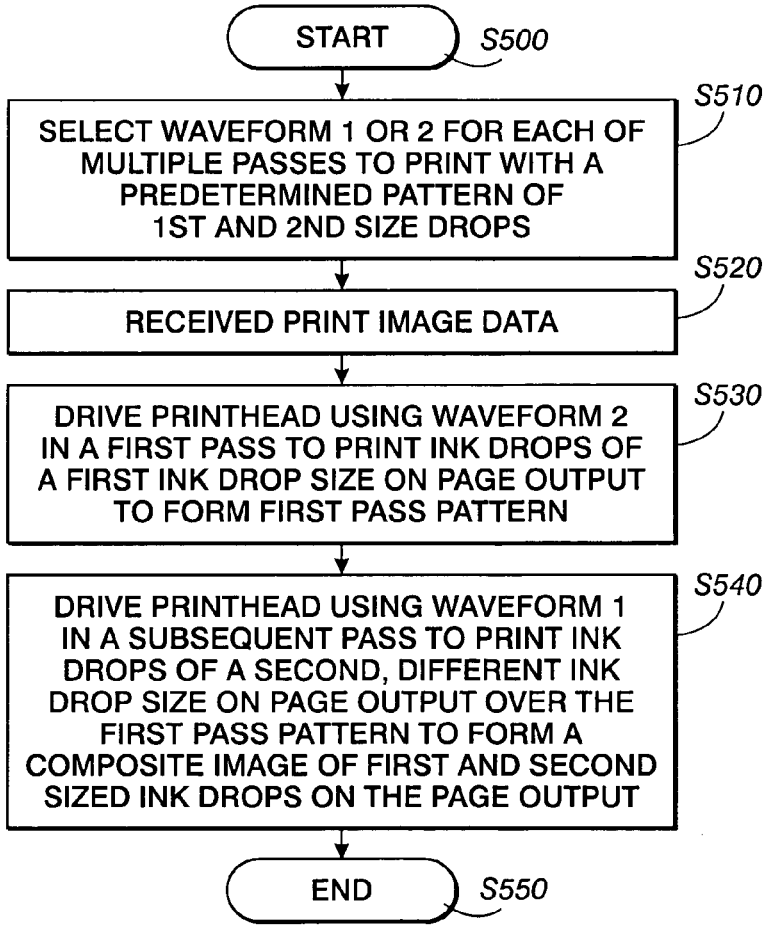
FIG. 6 illustrates an exemplary flowchart showing a method for generating a page output from a printer having an alternating pattern of large and small ink drops.
Figure 7:
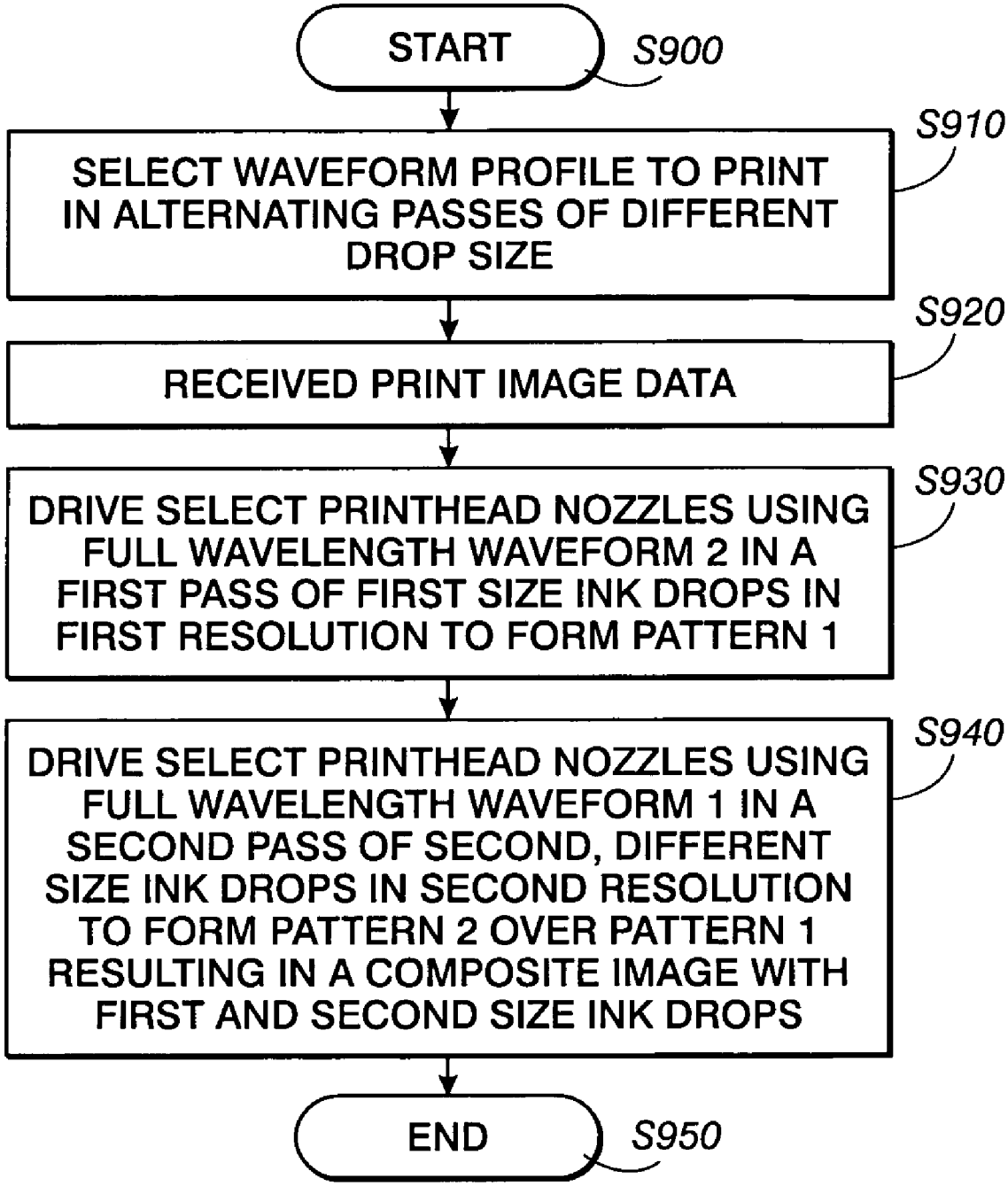
FIG. 7 illustrates a flowchart of a specific exemplary embodiment for generating a page output from a printer having an alternating pattern of large and small ink drops arranged in an overlaying grid.

A basic method of printing using the printhead and driver of FIGS. 3-5 will be described with reference to FIG. 6. The process starts at step S500 and advances to step S510 where selector 330 of driver 300 selects an appropriate waveform pattern to drive the nozzle array in each of multiple passes. From step S510, flow advances to step S520 where page image data is received for processing. Then, at step S530, driver 300 drives the nozzle array based on the page image data and based on a first predefined waveform pattern selected to output an image in a first pass using a first drop size. The process then advances to step S540 where driver 300 drives the nozzle array based on the page image data and based on a second predefined waveform pattern selected to output an image in a subsequent pass using a second, different drop size to form a composite image with both first and second drop sizes in a pattern on the page output.

Alternatively, the step of receiving image data can be performed prior to selection of waveform pattern by selector 330. This could, for example, take into account global properties of the received image and use this information to determine which global page-based or sub-page based pattern of large and small drops would produce better image quality. For example, if the image data was primarily solid fill, one pattern with a more dominant mix of large drops may be better than another pattern. Likewise, an image with a lot of light fill areas may have better print quality if a pattern with more dominant small drops is present.

The resolution of each pass does not have to be the same. For example, the large drops can be provided at 400×400 dpi while the small drops are at 200×200 dpi. Higher quality modes would tend towards more small drops at higher resolution combined with fewer large drops. Alternatively, lower quality modes would tend more towards more large drops at lower resolution combined with relatively fewer smaller drops. More specific examples of these will be described with reference to the following embodiments.

Figure 8:
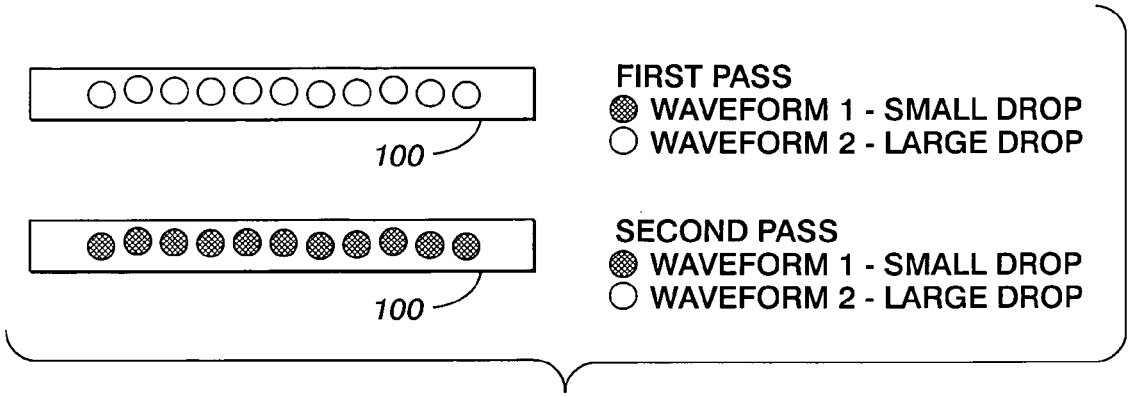
FIG. 8 illustrates consecutive printhead passes driven by the method of FIG. 7.
Figure 9:
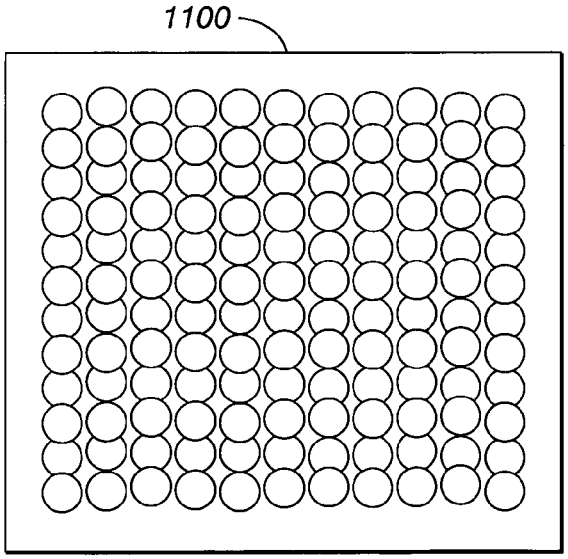
FIG. 9 illustrates an exemplary dual drop printing output in accordance with the method of FIG. 7 after pass 1.

A first specific embodiment will be described with reference to FIGS. 7-11 and achieves printing of an image with a pattern of small and large drops arranged in an overlapping grid. The process starts a step S900 and flows to step S910 where a waveform pattern is selected to achieve alternating passes of at least two different drop sizes (large and small). From step S910, flow advances to step S920 where page image data is received that corresponds to a specific input image to be reproduced. From step S920, flow advances to step S930 where select printhead nozzles are driven using full wavelength waveform 2 in a first pass to form a pattern of first sized ink drops (e.g., large drops). For example, as shown in FIG. 8, a single array of nozzles 190 provided on printhead 100 can be driven in a first cycle such that all nozzles corresponding to the image are driven with waveform 2 to achieve a pattern of large ink drops. An example of formed pattern 1100 is shown in FIG. 9.

Figure 10:
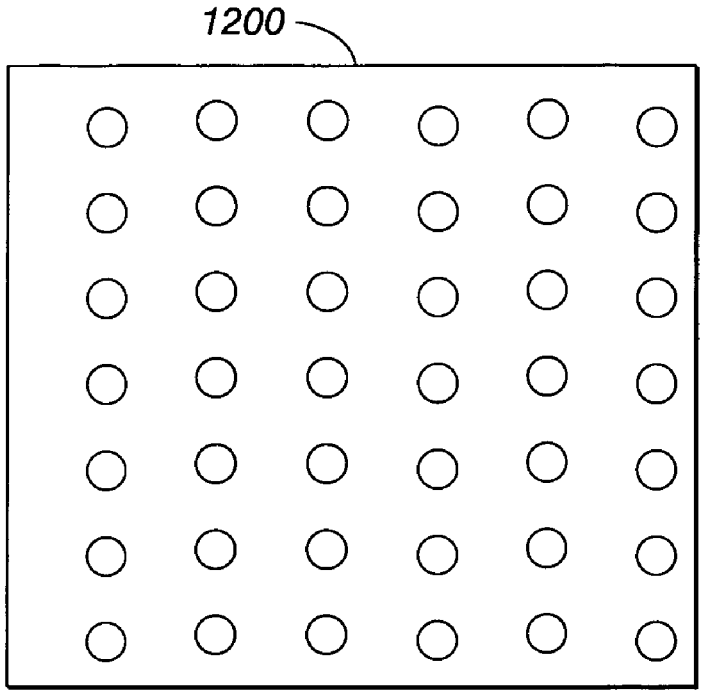
FIG. 10 illustrates an exemplary dual drop printing output in accordance with the method of FIG. 7 showing a second pass printed with small drops.
Figure 11:
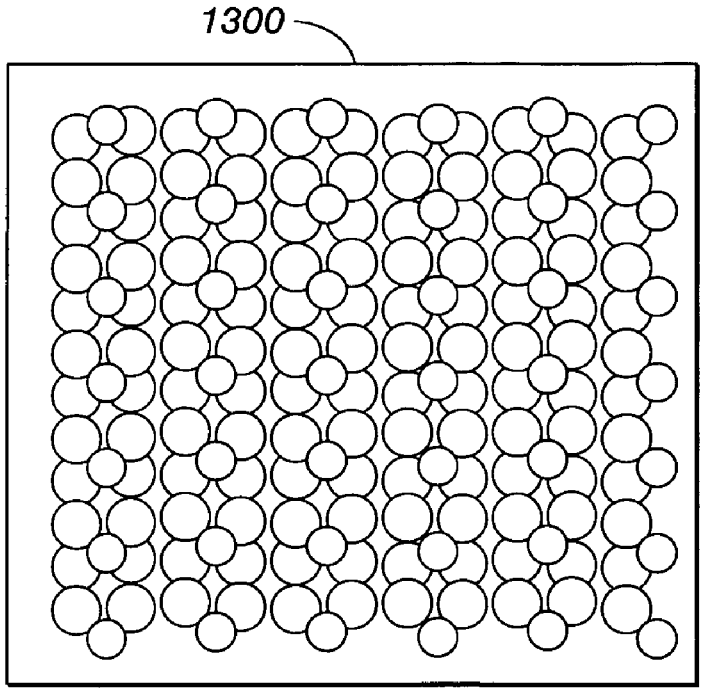
FIG. 11 illustrates a resultant composite image print output in accordance with the method of FIG. 7 after printing of both the first pass large drops and the subsequently applied second pass of small drops over the first pass.

From step S930, flow advances to step S940, where a subsequent pass is made in which the printhead is driven using waveform 1 to form a second pattern of second, different size drops (e.g., small drops). For example, in FIG. 8, a second cycle of the single array 190 of printhead 100 is driven with waveform 1 such that all nozzles corresponding to the image are driven to achieve a second pattern of small drops. An example of pattern 1200 is shown in FIG. 10. This forms a composite image 1300 (pass 1+pass 2 images) that includes both first and second (large and small) ink drop sizes on the page output as shown in FIG. 11. From step S940, flow advances to step S950, where the process ends.

Thus, depending on desired resolution and interlace, printing can be performed to achieve one-half the area with small drops and one-half the area with large drops. Such patterning across the image of the page achieves benefits of using each drop size, and does not suffer the problems associated with using only a single drop size. That is, by selecting and using only one of the two fill length waveforms, print frequency can be optimized for each in order to improve overall print speed. Moreover, by using both drop sizes on a page in an alternating manner, benefits attributed to each drop size can be realized to improve image quality at both solid fill and light fill regions of an image. Thus, the quality/speed tradeoff can be lessened.

Because there is no need to determine drop size on a pixel-by-pixel basis based on image data, image processing can be simplified while the patterning of large and small drops achieves advantages to use of each size.

In the example shown, there is a 4:1 ratio of large to small drops achieved by printing pass 1 using the large droplet waveform 1 at a resolution of 400×400 dpi and printing pass 2 using the small droplet waveform 2 at a resolution of 200×200 dpi. Other ratios of 1:1, 2:1, 3:2, 5:2, etc. can be substituted and can be dominant with either the small drop size or the large drop size.

Various other strategies could be provided. For example, based on the image and resolution details, it may be preferable to have the pattern aligned in rows or columns or include shifts to take into account x-resolution or y-resolution problems with a particular printer architecture.

A large drop in exemplary embodiments useful in a monochrome or color solid ink-based piezo fluid ejector or printer is set to about 31 ng or higher, but would depend on several considerations, including a desired small drop size, ink dye loading, etc. A small drop requirement should be less than about 24 ng, and preferably in the range of around 10-20 ng. Therefore, in preferred embodiments using solid ink-based fluid ejectors, the nozzle geometry and/or waveform(s) selected would be chosen to provide an alternating pattern of large and small ink drops where the large drop is set to be about 31 ng, and the small drop is set to be less than 24 ng, preferably 10-20 ng. This combination of drop size has been found to achieve acceptable text quality, improve light fill areas and reduce graininess as well as improve image transfer and maximize print speed.

A halftone, including under color, would take this imaging method into account. Use of the small drop would be maximized to the extent possible in much of the lower fill areas, while the large drop and/or both drops together would be maximized in large fill areas, etc. For example, in various embodiments, isolated large drops could be replaced with isolated small drops but one pixel away in either the x or y axis, etc. The alternative pattern can be chosen based on a global assessment of the received image data, such as on a page-by-page or sub-page basis rather than a pixel-by-pixel basis or a completely arbitrary patterning that does not take into account actual image content and type.

Figure 12:
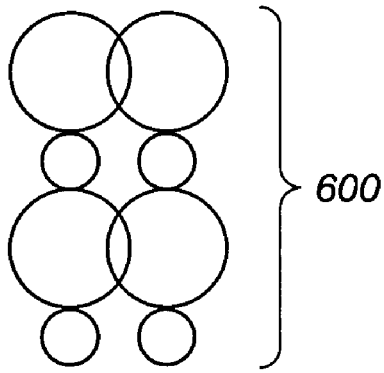
FIG. 12 illustrates an exemplary pattern of alternating rows of large and small drops formed by a combination of two print passes in accordance with the method of FIG. 6.
Figure 13:
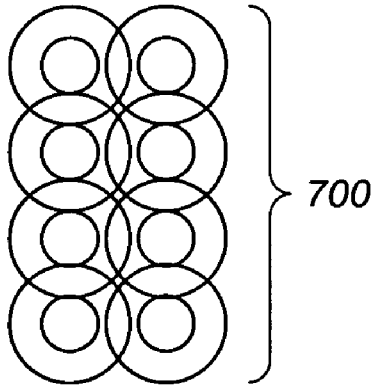
FIG. 13 illustrates an exemplary pattern of completely overlapping large and small drops formed by a combination of two print passes in accordance with the method of FIG. 6.
Figure 14:
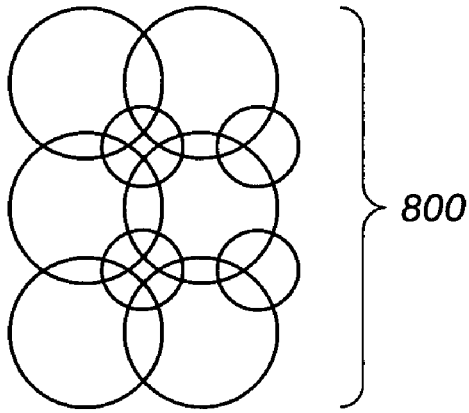
FIG. 14 illustrates an exemplary overlay pattern in which the small drops are offset in the x-direction, y-direction or both to improve fill or image quality.

It should be appreciated that various timing and control techniques can be used to improve image quality using various combinations of large and small drops. For example, it can be adjusted using conventional techniques to provide: pattern 600 of alternating rows of large and small drops (FIG. 12); pattern 700 of completely overlapping large and small drops, forming a drop mass of a quantity equal to the combination of the large and small drop (FIG. 13); and pattern 800 showing a dimensional offset between the large and small drops (FIG. 14). This can be useful in obtaining better coverage and less jagged edges by providing small drops at areas of coverage typically missed by the larger round droplets.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method for ejecting at least two different fluid drop sizes from a fluid ejector nozzle array having common nozzle geometry in accordance with a page patterning methodology, comprising:

selecting, from at least two different full length waveforms, a particular first waveform to drive each individual nozzle of the array with, to eject a predetermined pattern of a first drop size at a first predetermined resolution in a first pass;

selecting, from at least two different full length waveforms, a particular second waveform different from the first waveform to drive each individual nozzle of the array with, to eject a predetermined pattern of a second, different drop size at a second predetermined resolution in a subsequent pass;

receiving image data; and driving the nozzle array using the selected patterns to eject fluid based on the received image data in first and second passes to form a composite image having a pattern containing both the first and second drop sizes.

2. The method according to claim 1, wherein the pattern is arranged in alternating rows or columns of large and small drops.

3. The method according to claim 2, wherein a ratio of first and second drops in the pattern is approximately 1:1.

4. The method according to claim 2, wherein a ratio of first and second drops in the pattern is substantially different from 1:1 so that one particular drop size is dominant in the pattern to improve image quality.

5. The method according to claim 2, wherein the specific pattern used is selected based on a global analysis of the image data.

6. The method according to claim 2, wherein the pattern is applied on a page-by-page basis.

7. The method according to claim 2, wherein the pattern is applied on a sub-page basis.

8. The method according to claim 1, wherein the fluid ejected is ink.

9. The method according to claim 1, wherein the large drop size has about twice the mass as the small drop size.

10. The method according to claim 1, wherein the large drop size is about 31 ng or higher and the small drop size is about 24 ng or less.

11. The method according to claim 10, wherein the small drop size is between about 10-20 ng.

12. An apparatus for ejecting a fluid in a pattern of at least first and second different drop sizes, comprising:

a fluid ejector nozzle array having a plurality of fluid nozzles, each having a common nozzle geometry;

a fluid ejector driver capable of driving each individual nozzle with a selected one of at least two different full wavelength waveforms, each waveform causing ejection of a different drop size;

an image data input that receives image data from a source; and a waveform selector that selects one of the at least two different full wavelength waveforms drive each individual nozzle of the nozzle array in accordance with a predefined page patterning methodology, wherein the nozzle array is driven based on the received image data during a first pass to eject drops in a first resolution accordance with the image data to create a first pattern having a first drop size, and wherein the nozzle array is driven based on the received image data during a subsequent pass in a second resolution to eject drops in accordance with the image data on top of the first pattern to create a second pattern having a second drop size different from the first drop size, the first and second patterns forming a composite image containing both first and second drops sizes.

13. The apparatus according to claim 12, wherein the apparatus is a printer.

14. The apparatus according to claim 12, wherein the fluid ejector is a piezoelectric-based printhead.

15. The apparatus according to claim 12, wherein the pattern is applied on a page-by-page basis.

16. The apparatus according to claim 12, wherein the large drop size is about 31 ng or higher and the small drop size is about 24 ng or less.

17. The apparatus according to claim 12, wherein the second resolution is different from the first resolution.

18. The apparatus according to claim 12, wherein a ratio of the number of second drops relative to the number of first drops is substantially different from 1:1 so that one particular drop size is dominant in the image to improve image quality.

19. The apparatus according to claim 12, wherein the specific pattern used is selected based on a global analysis of the page image data.

20. A printer for ejecting ink in a pattern of at least first and second different drop sizes, comprising:

a printhead having an array of ink nozzles, each having a common nozzle geometry;

a driver capable of driving each individual nozzle with a selected one of at least two different full wavelength waveforms in each of multiple printhead passes, each waveform causing ejection of a different drop size;

an image data input that receives image data from a source; and a waveform selector that selects one of the at least two different full wavelength waveforms to drive each individual nozzle of the nozzle array in accordance with a predefined page patterning methodology that is applied on at least a sub-page basis, wherein the nozzle array is driven based on the received image data to eject drops in accordance with the image data, the ejected fluid from the first pass prints a swath using a first drop size and a second pass prints a swath on top of the first pass using a second, different drop size to form a composite image containing both first and second drop sizes.

* * * * *